US009543063B2

(12) United States Patent
Chen et al.

(10) Patent No.: US 9,543,063 B2
(45) Date of Patent: Jan. 10, 2017

(54) CONTINUOUS HYDROGEN PULVERIZATION METHOD AND PRODUCTION DEVICE OF RARE EARTH PERMANENT MAGNETIC ALLOY

(71) Applicant: SHENYANG GENERAL MAGNETIC CO., LTD, Shenyang, Liaoning (CN)

(72) Inventors: Xiaodong Chen, Shenyang (CN); Baoyu Sun, Shenyang (CN)

(73) Assignee: SHENYANG GENERAL MAGNETIC CO., LTD, Shenyang, Liaoning Province (CN)

( * ) Notice: Subject to any disclaimer, the term of this patent is extended or adjusted under 35 U.S.C. 154(b) by 474 days.

(21) Appl. No.: 14/075,801

(22) Filed: Nov. 8, 2013

(65) Prior Publication Data

US 2014/0123811 A1 May 8, 2014

(30) Foreign Application Priority Data

Nov. 8, 2012 (CN) ..... 2012 1 0444002
Nov. 8, 2012 (CN) ..... 2012 1 0444480

(51) Int. Cl.
*H01F 1/053* (2006.01)
*H01F 1/057* (2006.01)
*H01F 1/055* (2006.01)

(52) U.S. Cl.
CPC ..... *H01F 1/0573* (2013.01); *H01F 1/0553* (2013.01)

(58) Field of Classification Search
None
See application file for complete search history.

(56) References Cited

U.S. PATENT DOCUMENTS 5,505,794 A * 4/1996 Nakayama ..... B22F 9/023 148/508
2005/0183791 A1* 8/2005 Hidaka ..... C22C 1/0441 148/103
2012/0153759 A1* 6/2012 Kawashita ..... B22F 1/02 310/152

FOREIGN PATENT DOCUMENTS

JP 2005-118625 5/2005

OTHER PUBLICATIONS

Translation of JP 2005-118625 from J Plat Pat (published May 12, 2005).*

* cited by examiner

*Primary Examiner* — George Wyszomierski

(57) ABSTRACT

A continuous hydrogen pulverization method of a rare earth permanent magnetic alloy includes: providing a hydrogen adsorption room, a heating dehydrogenation room and a cooling room in series, applying hydrogen adsorption, heating dehydrogenation and cooling on a rare earth permanent magnetic alloy in the production device at the same time, wherein collecting and storing under an inert protection atmosphere can also be provided. Continuous production is provided under vacuum and the inert protection atmosphere in such a manner that an oxygen content of the pulverized powder is low and a proportion of single crystal in the powder is high.

3 Claims, 7 Drawing Sheets

CONTINUOUS HYDROGEN PULVERIZATION METHOD AND PRODUCTION DEVICE OF RARE EARTH PERMANENT MAGNETIC ALLOY

CROSS REFERENCE OF RELATED APPLICATION

The present invention claims priority under 35 U.S.C. 119(a-d) to CN 201210444480.1, filed Nov. 8, 2012 and CN 201210444002.0, filed Nov. 8, 2012.

BACKGROUND OF THE PRESENT INVENTION

Field of Invention

The present invention relates to a continuous hydrogen pulverization method and a production device of a rare earth permanent magnetic alloy Description of Related Arts Melt-spun neodymium-iron-boron (NdFeB for short) rare earth permanent magnetic powder is mixed with resin of the same volume for forming a bonded magnet. The bonded magnet is widely utilized in electronic, electrical appliance and motor fields, and has wider and wider application. The rare earth hydrogen storage alloy is also a material for producing the negative electrode of a nickel-metal hydride battery (NI-MH battery for short) and is widely utilized in electrical tools, hybrid cars, etc. The rare earth hydrogen storage alloy has wider and wider application, too.

The conventional hydrogen pulverization device of the NdFeB rare earth permanent magnetic alloy is a hydrogen pulverization furnace with a rotary inner tank. The rotary inner tank is supported by support parts at the two ends. An electrical heating furnace comprising an openable first furnace body and an openable second furnace body cases around the inner tank. A first end of the inner tank comprises a material inlet and a material outlet, and a second end of the inner tank can hermetically communicates with a vacuum pump and an air distributor.

In the conventional rotary hydrogen pulverization furnace, it is difficult to collect the magnetic powder under the protection of inert gases. The cooling speed is low. And the operation period is long that may take dozens of or even over thirty hours. The conventional rotary hydrogen pulverization furnace is an external-heating muffle furnace which takes a lot of power.

SUMMARY OF THE PRESENT INVENTION

An object of the present invention is to provide a continuous hydrogen pulverization method and a production device of a rare earth permanent magnetic alloy for solving the above problems.

Accordingly, in order to accomplish the above objects, the present invention provides a continuous hydrogen pulverization method of a rare earth permanent magnetic alloy, comprising:

A) displacing a feeding tank containing rare earth permanent magnetic alloy slices on a feeding rack, hanging the feeding rack on a transmission device, displacing the feeding tank into a hydrogen adsorption room, evacuating the hydrogen adsorption room after closing a valve, filling with hydrogen to 0.5-0.15 MPa after a vacuum pressure is lower than 50 Pa or a volume content of oxygen is less than or equal to 0.1%, keeping for 10~120 min, releasing the hydrogen, opening a first isolation valve between the hydrogen adsorption room and a heating dehydrogenation room when pressure in the hydrogen adsorption room equals to pressure in the heating dehydrogenation room, then displacing the feeding tank into the heating dehydrogenation room and closing the first isolation valve;

B) heating when the pressure in the heating dehydrogenation room is less than 0.1 Pa, a highest heating temperature is 500~900° C. with a heating time of 4~20 h, opening an second isolation valve between the heating dehydrogenation room and a cooling room when pressure in the heating dehydrogenation room equals to pressure in the cooling room, then displacing the feeding tank into the cooling room and closing the second isolation valve; and C) filling the cooling room with inert gases until gas pressure is 0.05-0.6 Mpa, then starting a fan for driving the inert gases into a vent tube of the feeding tank through a cambered deflector on an internal wall of the cooling room; after the inert gases enters the vent tube, cooling the feeding tank and the alloy slices in the cooling room with the inert gases, then cooling the heated inert gases by a heat exchanger before being blown to the cambered deflector for providing inert gas circulating cooling, adjusting the pressure to 1 atm when a temperature is lower than or equal to 120° C. due to the inert gas circulating cooling, opening an material outlet for taking the feeding tank out.

Preferably, when two or more heating dehydrogenation rooms are provided, the heating time in the step B) is equally allocated to each the heating dehydrogenation room.

Preferably, when two or more cooling rooms are provided, the cooling time in the step C) is equally allocated to each the cooling room.

A production device of a rare earth permanent magnetic alloy is also provided, comprising:

a hydrogen adsorption room;

a heating dehydrogenation room;

a cooling room;

a first isolation valve;

a second isolation valve; and a vacuum pump;

wherein the hydrogen adsorption room is connected to the heating dehydrogenation room by the first isolation valve, the heating dehydrogenation room is connected to the cooling room by the second isolation valve;

wherein a transmission device is provided above the hydrogen adsorption room, the heating dehydrogenation room and the cooling room; a feeding tank is hung on the transmission device.

Preferably, a water cooling tube or a jacket is provided on an external wall of the hydrogen adsorption room, a vacuum pump tube, a hydrogen inlet tube, an inert gas inlet tube, a safety valve, a pressure gauge, a pressure sensor and a thermocouple are also provided on the hydrogen adsorption room, the vacuum pump tube is connected to the vacuum pump.

Preferably, one or more heating dehydrogenation rooms are provided in series, vertical rectangle heating furnaces are provided therein; an insulation layer is provided on an internal wall of the heating furnace, a plurality of heaters are provided in the insulation layer; the transmission device is provided outside the heating furnace; an insulation board is provided in a top of the heating furnace; a water cooling tube or a jacket is provided on an external wall of the heating dehydrogenation room, a vacuum pump tube, a hydrogen inlet tube, a safety valve and a pressure gauge are also provided on the heating dehydrogenation room, the vacuum pump tube is connected to the vacuum pump.

Preferably, bidirectional sealing gate valves are provided between the heating dehydrogenation room and the hydrogen adsorption room as well as between the hydrogen adsorption room and atmosphere, unidirectional sealing gate valves are provided between other rooms.

Preferably, the unidirectional sealing gate valve comprises:

a valve body;

a second air cylinder;

a plurality of air or oil cylinders;

a first valve plate;

a valve plate moving gear;

a rigid cooling water inlet and outlet tube set, a front blind flange; and a rear blind flange;

wherein the front and rear blind flanges are provided at two sides of the valve body, the second air cylinder and the rigid cooling water inlet and outlet tube set are provided on a top of the front blind flange, the first valve plate is provided in the valve body and is parallel to two side walls of the valve body, the first valve plate is hung in a top of the valve body by the valve plate moving gear, the valve plate moving gear is rigidly connected to a head portion of a cylinder lever of the second air cylinder, a pulley rail is provided between a bottom of the first valve plate and the valve body, a water cooling tube or a jacket is welded on the first valve plate and is connected to two sealing rigid cooling water tube axles by flexible tubes of the rigid cooling water inlet and outlet tube set, the cooling water tube axle of the rigid cooling water inlet and outlet tube set is connected to the cylinder lever of the second air cylinder for forming a linkage, the first valve plate is relatively static according to the cooling water tube axle when moving, a plurality of the air or oil cylinders are provided outside the valve body and are respectively connected to two sides of the valve plate for locking and sealing the first valve plate.

Preferably, the valve plate moving gear comprises:

a top rail provided at a top of the valve body;

a pulley set; and a pulley connector;

wherein the pulley set is provided in the top rail and hangs the first valve plate on the top rail by the pulley connector.

Preferably, the bidirectional sealing gate valve has a similar structure as the unidirectional sealing gate valve except for a second valve plate symmetrical to the first valve plate and two lines of air or oil cylinders connected to two sides of the second valve plate.

Preferably, one or more cooling rooms are provided in series, a water cooling tube or a jacket is provided on an external wall of the cooling room, a second motor is provided on a side wall of the cooling room, a bellows is also provided in the cooling room, a plurality of air deflection tubes are provided on a first side plate of the bellows, a heat exchanger is provided on a second side plate of the bellows, an outlet of the heat exchanger points at a fan, the fan is axially connected to the second motor, a cambered air deflector is provided around the cooling room; a vacuum pump tube, an inert gas inlet tube and a safety valve are also provided on the cooling room, the vacuum pump tube is connected to the vacuum pump.

Preferably, the feeding tank comprises:

a material container;

a vent tube; and a hinge;

wherein a plurality of rows of oval shaped tubes passing through the material container are provided on opposite walls thereof, holes through which the material container is communicated with are drilled on the vent tube, a bottom of the feeding tank is a door with the hinge which rotates outwardly.

Preferably, a discharge room is provided at an end of the cooling room, a material collector is provided under the discharge room, the material collector is connected to a material storage through a glove box; valves are provided in an inlet tube and an outlet tube of the glove box; an inert gas inlet tube, a pressure gauge and an outlet valve are provided on the discharge room.

Therefore, advantages according to the present invention are as follow:

a) The conventional continuous hydrogen pulverization furnace utilizes bottom transmission. And transmission parts are provided in a hotspot, which will lead to deformation and a short life. For improving stability, a length of the feeding tank is similar to a width thereof, which will lead to a bed consistency of core hydrogen adsorption and dehydrogenation as well as external hydrogen adsorption and dehydrogenation. For overcoming the above disadvantages, the feeding tank is hung while transmitting according to the present invention. The feeding tank is tall and thin. A thickness is less than 300 m and a height is over 2000 mm. Hydrogen adsorption and dehydrogenation speeds are high and consistency is sufficient, which means product performance is improved while costs are saved. Furthermore, the transmission parts are not provided in the hotspot for preserving the transmission parts from deformation, ensuring a long life and improving the stability. Compared with the conventional technology, the present invention has significant advantages.

b) Compared with the conventional rotary hydrogen pulverization furnace, the hydrogen adsorption room, the heat dehydrogenation room and the cooling room are connected in series by the valves. A hydrogen adsorption treatment, a heating dehydrogenation treatment, a cooling treatment and a storage treatment under protection atmosphere are applied on the rare earth permanent magnetic alloy at the same time. With the foregoing structure, problems that it is difficult to collect magnetic powder from the conventional rotary hydrogen pulverization furnace under protection of the inert gases, a cooling speed is low, an operation period is long and an external-heating muffle furnace takes a lot of power, are solved. Continuous production is provided under vacuum and inert protection atmosphere. Under a condition of saving power, production capacity is high, the consistency is sufficient, an oxygen content of the pulverized powder is low, a proportion of single crystal in the powder is high and the performance is high. At the same time, life duration is enlarged, maintenance period is shortened.

These and other objectives, features, and advantages of the present invention will become apparent from the following detailed description, the accompanying drawings, and the appended claims.

Figure 1:
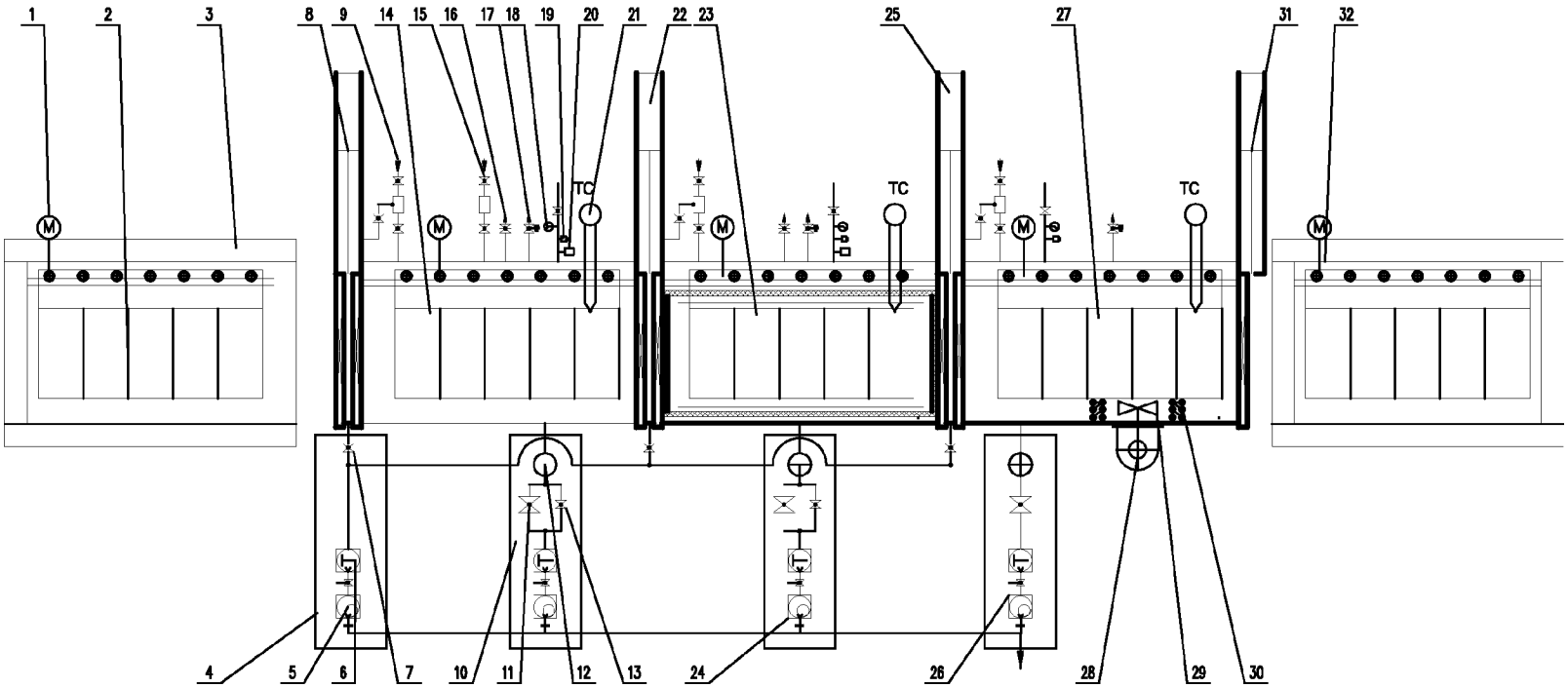
FIG. 1 is a sketch view of a rare earth permanent magnetic alloy hydrogen pulverization device according to a preferred embodiment of the present invention.

Reference numbers of elements: 1—first motor, 2—feeding tank, 3—inlet transition frame, 4—first vacuum pump, 5—rotary vane pump, 6—Roots pump, 7—flapper valve, 8—first valve, 9—inert gas inlet tube, 10—second vacuum pump, 11—main pump valve, 12—filter, 13—by pass valve, 14—hydrogen adsorption room, 15—hydrogen inlet tube, 16—passive safety valve, 17—active safety valve, 18—electric contact pressure gauge, 19—vacuum gauge, 20—pressure sensor, 21—first thermocouple, 22—second valve, 23—heating dehydrogenation room, 24—third vacuum pump, 25—third valve, 26—fourth vacuum pump, 27—cooling room, 28—second motor, 29—fan, 30—heat exchanger, 31—fourth valve, 32—outlet transition frame, 33—photoelectric switch, 34—inert gas inlet tube flange, 35—hydrogen inlet tube flange, 36—safety valve tube flange, 37—roller, 38—second chain wheel, 39—gear pair, 40—bearing holder, 41—cooling water nozzle, 42—vacuum pump tube flange, 43—thermocouple, 44—spring plate, 45—chain, 46—third motor, 47—feeding rack, 48—rail, 49—safety valve tube flange, 50—air inflation flange, 51—insulation board, 52—evacuation flange, 53—upper insulation board, 54—first air cylinder, 55—second thermocouple, 56—water cooled electrode, 57—side insulation board, 58—heater, 59—lower insulation board, 60—air deflection tube, 61—air deflector, 62—bottom rotary door, 63—material container, 64—frame, 65—vent tube, 66—chain, 67—second air cylinder, 68—first limit switch, 69—front blind flange, 70—pump flange, 71—air inflation flange, 72—valve body, 73—second limit switch, 74—air or oil cylinder, 75—rubber ring, 76—insulation layer, 77—first valve plate, 77'—second valve plate, 78—rear blind flange, 79—pulley, 80—guide rail, 81—pulley connector, 82—top rail, 83—cooling water tube axle, 84—flexible tube, 85—fifth isolation valve, 86—air inflation tube, 87—pressure gauge, 88—outlet valve, 89—sixth valve, 90—material collector, 91—manual valve, 92—glove box, 93—material storage, 94—discharge room, 95—pump hole, 96—dovetail slot, 97—first chain wheel, 98—chain plate.

DETAILED DESCRIPTION OF THE PREFERRED EMBODIMENT

Referring to the drawings, the present invention is further illustrated according to preferred embodiments.

Preferred embodiment: Referring to FIG. 1 of the drawings, a production device of a rare earth permanent magnetic alloy according to a preferred embodiment of the present invention is illustrated, comprising:

an inlet transition frame 3;
a first valve 8;
a hydrogen adsorption room 14;
a second valve 22;
a heating dehydrogenation room 23;
a third valve 25;
a cooling room 27;
a fourth valve 31;
an outlet transition frame 32;
a loop frame;
an electrical control cabinet; and a vacuum pump;

wherein the hydrogen adsorption room 14 is connected to the heating dehydrogenation room 23 by the first isolation valve, the heating dehydrogenation room 23 is connected to the cooling room 27 by the second isolation valve; a transmission device is provided above the hydrogen adsorption room 14, the heating dehydrogenation room 23 and the cooling room 27; a feeding tank 2 is hung on the transmission device; the loop frame forms a loop rail with transmission devices of each the rooms, which provided a circular transmission, the feeding tank 2 is hung on the transmission device and slides along a transmission rail.

The inlet transition frame 3 is a preparation and transition area of transition. The inlet transition frame 3 can be a working rack exposed to atmosphere or a sealed box. A valve is provided on an inlet tube on a top of the box. A material storage is provided on the valve. The feeding tank 2 is vertically hung on the transition device and is transmitted by a rail, a chain wheel and a chain with frequency control function.

Figure 2:
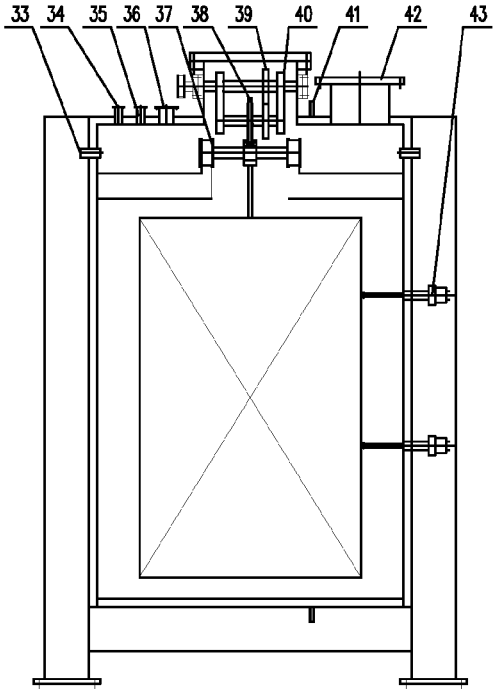
FIG. 2 is a sketch view of a hydrogen adsorption room according to the FIG. 1 of the present invention.
Figure 3:
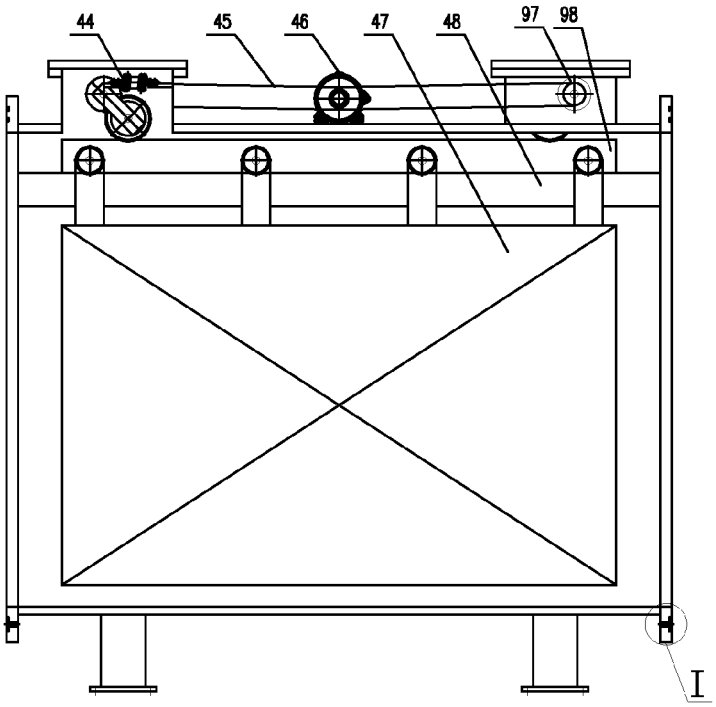
FIG. 3 is a left view according to the FIG. 2 of the present invention.
Figure 4:
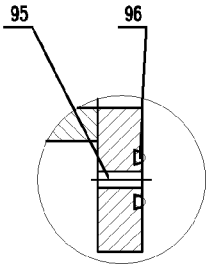
FIG. 4 is an enlarged view of a part I according to the FIG. 3 of the present invention.

Referring to FIG. 2 and FIG. 3 of the drawings, the hydrogen adsorption room 14 is a vertical box. A water cooling tube or a jacket is provided on an external wall of the hydrogen adsorption room 14. A vacuum pump tube, a hydrogen inlet tube 15, an inert gas inlet tube 9, an electrically controlled active safety valve 17, a fragment passive safety valve 16, an electric contact pressure gauge 18, a vacuum gauge 19, a pressure sensor 20 and a first thermocouple 21 are also provided on a top of the hydrogen adsorption room. The vacuum pump tube is connected to the vacuum pump. When a leak rate of the hydrogen adsorption room 14 is higher than a predetermined value, hydrogen supply is stopped. When a temperature is higher than a predetermined value, the hydrogen supply is also stopped. Referring to FIG. 4 of the drawings, double seals formed by two dovetail slots 96 and two rubber rings mounted therein are provided on a connection flange of the hydrogen adsorption room 14. Pump holes 95 are drilled between the two dovetail slots 96 for inflating inert gases. The feeding tank 2 is hung on the transmission device. Photoelectric switches are provided on symmetrical side walls of the hydrogen adsorption room 14 for displaying a position of the feeding tank 2 and adjusting frequency. The rare earth permanent magnetic alloy is pulverized into powder in the hydrogen adsorption room 14.

Figure 5:
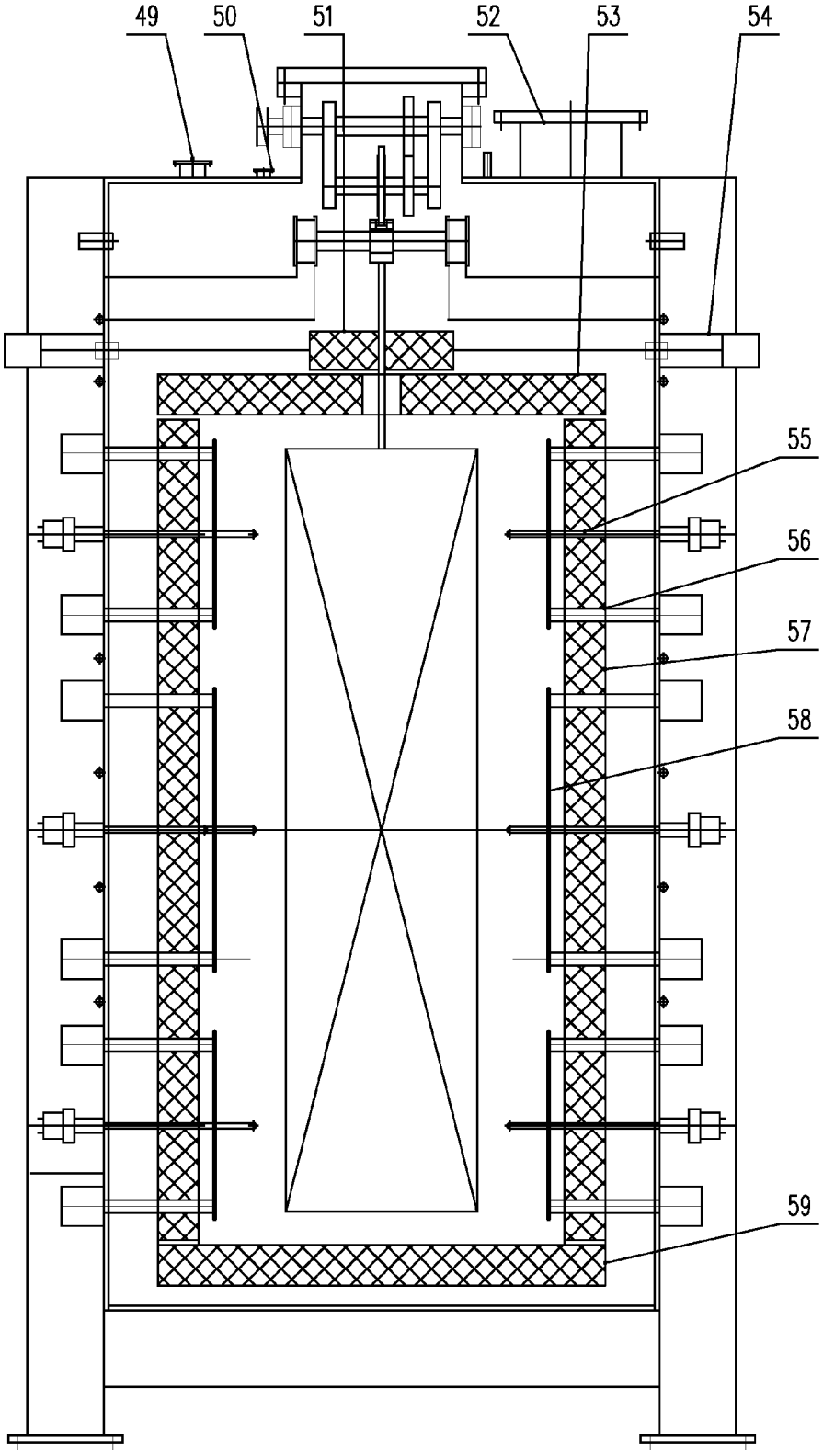
FIG. 5 is a sketch view of a heating dehydrogenation room according to the FIG. 1 of the present invention.

Referring to FIG. 5 of the drawings, the heating dehydrogenation room 23 is a vertical box. At least one heating dehydrogenation room 23 is provided. If there are more, the heating dehydrogenation rooms 23 are provided in series. Only one heating dehydrogenation room 23 is utilized according to the preferred embodiment. A water cooling tube or a jacket is provided on an external wall of the hydrogen adsorption room 23. A vacuum pump tube, an inert gas inlet tube 9, an electrically controlled active safety valve 17, a fragment passive safety valve 16, an electric contact pressure gauge 18, a vacuum gauge 19 and an air inflation tube are also provided on a top of the hydrogen adsorption room 23. The vacuum pump tube is connected to the vacuum pump. A vertical rectangle heating furnaces is provided in the heating dehydrogenation room 23. An insulation layer 76 formed by an upper insulation board 53, a side insulation board 57 and a lower insulation board 59 is provided in the heating furnace. A plurality of heaters 58 are provided in the insulation layer 76. A thermocouple 43 is provided in each of the heaters 58. Temperatures of the heaters 58 can be controlled independently. The transmission device is provided outside the heating furnace. An insulation board 51 which can be opened from left or right is provided on a top of the heating furnace. Two sides of the insulation board 51 are respectively connected to the first air cylinder 54. When a feeding rack is moving, the insulation board 51 is opened. When the feeding rack is stopped in a heating room, the insulation board 51 is closed. A water cooled electrode 56 and a second thermocouple 55 are provided on a side wall of the heating room. Inert gas tubes are provided at an outlet of the safety valve and an outlet tube of the vacuum pump tube for preventing explosion and ensuring safety. Double seals formed by two dovetail slots 96 and two rubber rings mounted therein are provided on a connection flange of the heating dehydrogenation 23. Pump holes 95 are drilled between the two dovetail slots 96 for inflating inert gases, which is the same as the structure of the hydrogen adsorption room 14. Referring to the FIG. 4 of the drawings, a pressure sensor is provided on a top of the heating dehydrogenation room 23. When a pressure of the hydrogen from the heating dehydrogenation room 23 is higher than a predetermined value, heating is stopped. The feeding tank 2 is hung on the transmission device. Correlated photoelectric switches are provided outside the heating room on symmetrical side walls of the heating dehydrogenation room 23 for displaying the position of the feeding tank 2 and adjusting frequency. The pulverized powder is dehydrogenated in the heating dehydrogenation room 23.

Figure 12:
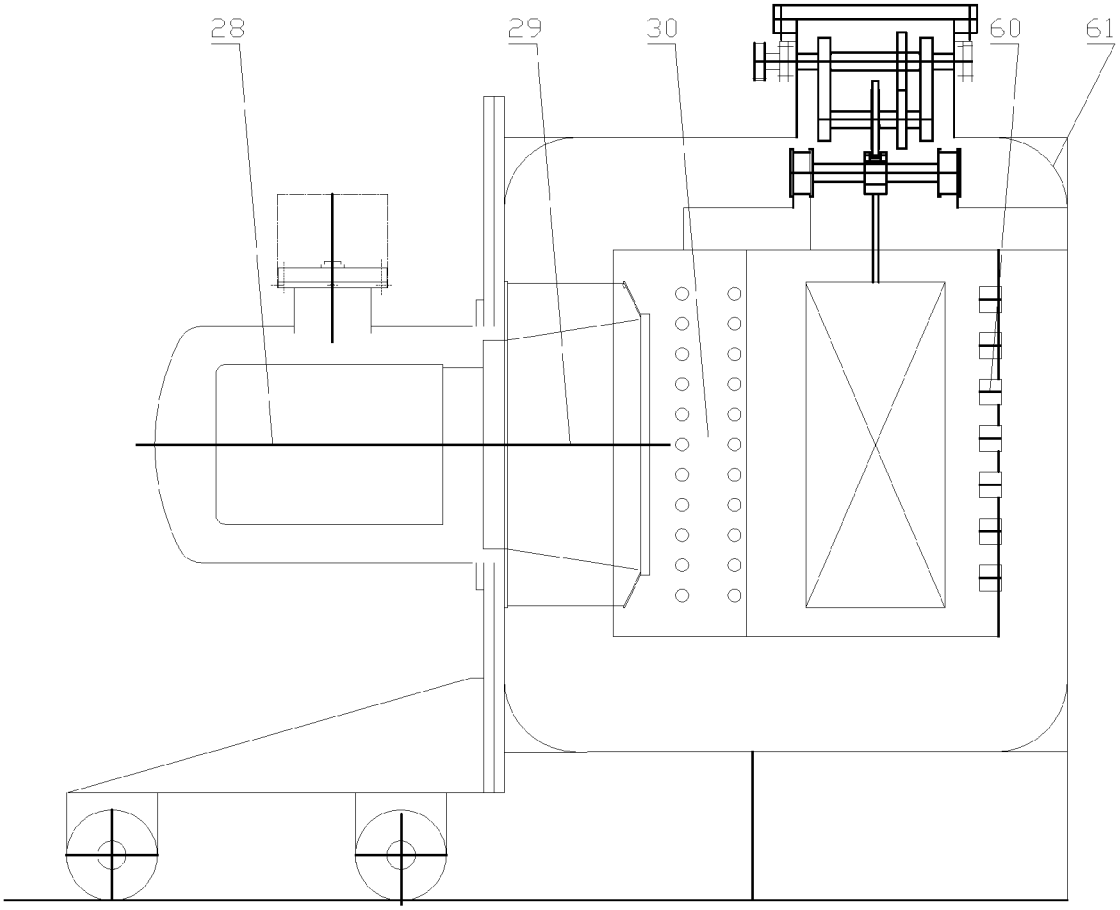
FIG. 12 is a sketch view of a cooling room according to the FIG. 1 of the present invention.

Referring to FIG. 12 of the drawings, the cooling room 27 is a vertical box. At least one cooling room 27 is provided. Only one cooling room 27 is utilized according to the preferred embodiment. A water cooling tube or a jacket is provided on an external wall of the cooling room 27. A second motor 28 is provided on a side wall of the cooling room 27. A bellows is provided in the cooling room 27. A plurality of air deflection tubes 60 are provided on a first side plate of the bellows. A heat exchanger 30 is provided on a second side plate of the bellows. An outlet of the heat exchanger 30 points at a fan 29. The fan 29 is axially connected to the second motor 28. A cambered air deflector 61 is provided around the cooling room 27. A vacuum pump tube, an inert gas inlet tube and a safety valve are also provided on the cooling room 27. The vacuum pump tube is connected to the vacuum pump. The feeding tank 2 is hung on the transmission device and is transmitted by a rail, a chain wheel and a chain. Correlated photoelectric switches are provided on symmetrical side walls of the cooling room 27 for displaying the position of the feeding tank 2 and adjusting frequency. The pulverized powder is cooled in the cooling room 27 by inflating inert gases. The cooling gas can be circularly utilized. When the pulverized powder reached a predetermined temperature, the fan is stopped and the feeding tank 2 is moved to a discharge room 94.

Figure 13:
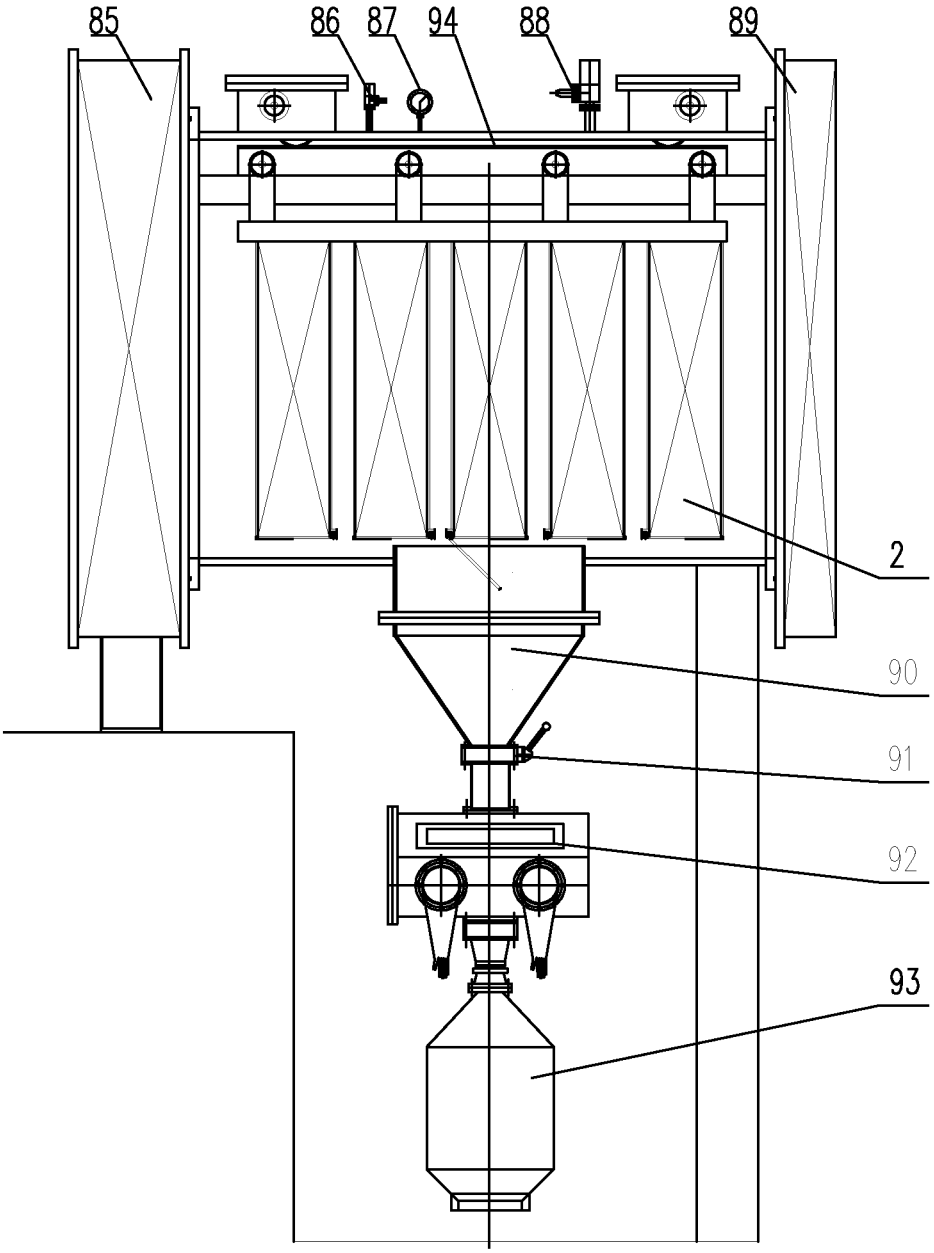
FIG. 13 is a partly view of a collection room according to the preferred embodiment of the present invention.

Referring to FIG. 13 of the drawings, a discharge room 94 is provided at an end of the cooling room 27. A material collector 90 is provided under the discharge room 94. The material collector 90 is connected to a material storage 93 through a glove box 92. An inert gas inlet tube 86, a pressure gauge 87 and an outlet valve 88 are provided on the discharge room 94. The glove box 92 is a glove box with an observation window. Manual valves 92 are provided on an inlet tube or an outlet tube of the glove box 92. When discharging, a bottom rotary door 62 of the feeding tank 2 in the discharge room 94 is opened and materials are moved into a material collector 90. An inert gas inlet tube, a pressure gauge, an outlet valve and the glove box 92 are provided on the discharge room 94. The feeding tank 2 is hung on the transmission device. Correlated photoelectric switches are provided on symmetrical side walls of the discharge room 94 for displaying the position of the feeding tank 2 and adjusting frequency. The pulverized powder is stored in a plurality of material storages 93 in the discharge room 94.

Bidirectional sealing gate valves are provided between the heating dehydrogenation room 23 and the hydrogen adsorption room 14 as well as between the hydrogen adsorption room 14 and atmosphere. Unidirectional sealing gate valves are provided between other rooms.

Figure 8:
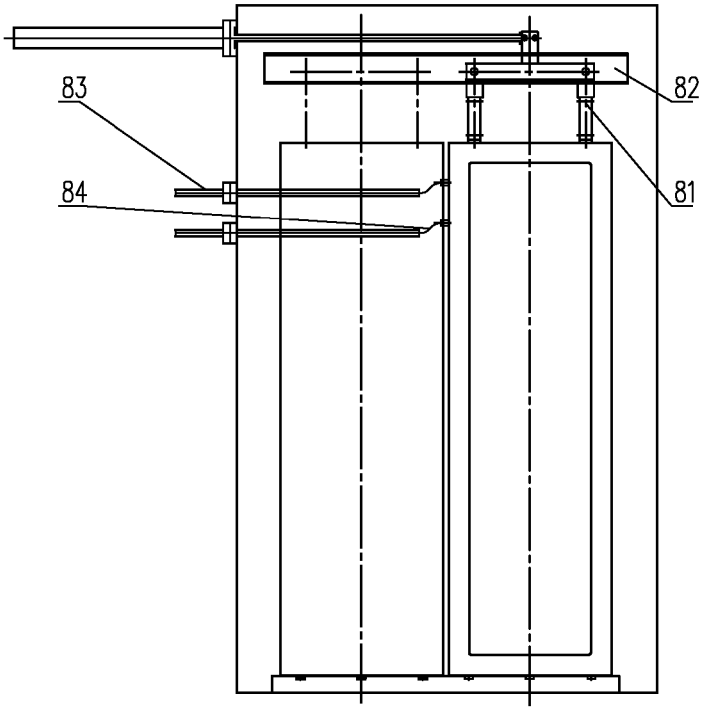
FIG. 8 is a sketch view of a unidirectional sealing valve according to the preferred embodiment of the present invention.
Figure 9:
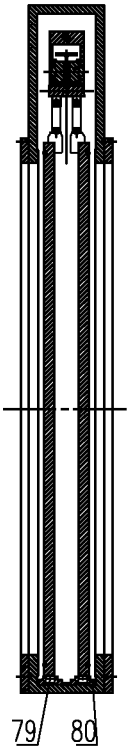
FIG. 9 is an A-A direction sectional view according to the FIG. 8 of the present invention.
Figure 10:
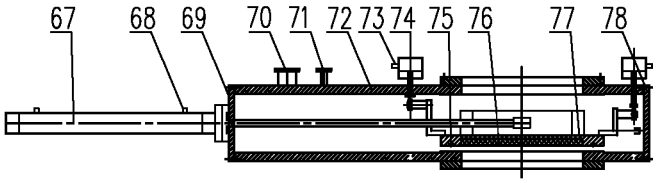
FIG. 10 is a B-B direction sectional view according to the FIG. 8 of the present invention.

Referring to FIG. 8~FIG. 10 of the drawings, the unidirectional sealing gate valve comprises:

a valve body 72;
a second air cylinder 67;
a plurality of air or oil cylinders 74;
a first valve plate 77;
a valve plate moving gear;
a rigid cooling water inlet and outlet tube set,
a front blind flange 69; and
a rear blind flange 78;

wherein the front blind flange 69 and the rear blind flange 78 are provided at two sides of the valve body 72. The second air cylinder 67 and the rigid cooling water inlet and outlet tube set are provided on a top of the front blind flange 69. The first valve plate 77 is provided in the valve body 72 and is parallel to two side walls of the valve body 72. The first valve plate 77 is hung in a top of the valve body 72 by the valve plate moving gear. The valve plate moving gear is rigidly connected to a head portion of a cylinder lever of the second air cylinder 67. A pulley 79 is provided at a bottom of the first valve plate 77 for cooperating with a guide rail 80 in the valve body 72. A water cooling tube or a jacket is welded on the first valve plate 77 and is connected to two sealing rigid cooling water tube axles 83 by flexible tubes 84 of the rigid cooling water inlet and outlet tube set. The cooling water tube axle 83 of the rigid cooling water inlet and outlet tube set is connected to the cylinder lever of the second air cylinder 67 for forming a linkage. The first valve plate 77 is relatively static according to the cooling water tube axle 83 when moving. A plurality of the air or oil cylinders 74 are provided outside the valve body 72 and are respectively connected to two sides of the valve plate 77 for locking and sealing the first valve plate 77. A first limit switch 68 and a second limit switch 73 are respectively provided on the second air cylinder 67 and a row of the air or oil cylinders 74 for controlling a position of the first valve plate 77. A sealing rubber ring 75 is provided on a valve port of the first valve plate 77. The first valve plate 77 is pushed by the air or oil cylinders 74 for ensuring averaged force distribution. The rubber ring 75 with large compression is provided on the first valve plate 77 for ensuring sealing effects of valve plates with large valve ports. When the front blind flange 69 and the rear blind flange 78 of the valve body 72 are in maintenance, the first valve plate 77 can be removed from a side of the valve body 72. An insulation board can be mounted on the first valve plate 77. An air inflection flange 71, a pump flange and a pressure gauge are also provided on the valve body 72. When the valve is closed, the inert gases are inflated from the air inflection flange 71 to the valve body 72. The pump flange 70 is connected to the vacuum pump. A pressure test is provided at the same time.

The valve plate moving gear comprises:

a top rail 82 provided at a top of the valve body 2;

a pulley set; and a pulley connector 81;

wherein the pulley set is provided in the top rail and hangs the first valve plate 77 on the top rail 82 by the pulley connector 81.

Figure 11:
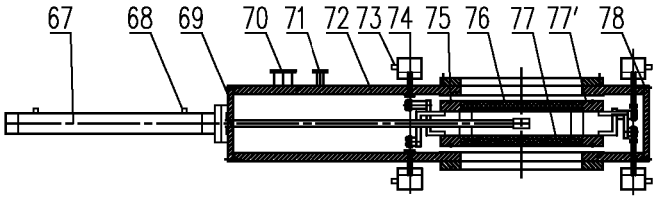
FIG. 11 is a sketch view of a bidirectional sealing valve according to the preferred embodiment of the present invention.

Referring to FIG. 11 of the drawings, in the bidirectional sealing gate valve has a similar structure as the unidirectional sealing gate valve except for a second valve plate 77' symmetrical to the first valve plate and two lines of air or oil cylinders connected to two sides of the second valve plate 77'. The valve plates are respectively connected to the valve plate moving gear.

Referring to the FIG. 2 and FIG. 3 of the drawings, the transmission device according to the present invention is provided, comprising:

a third motor 46;

a chain 45;

a gear pair 39, two bearing holders 40;

two parallel rails 48;

two sets of rollers 37;

two first chain wheels 97;

a second chain wheel 38; and a chain plate 98;

wherein the two first chain wheels 97 are mounted on a hinge shaft passing through shells of the rooms, an output shaft of the third motor 46 is connected to the first chain wheel 97 by the chain 45, first ends of the bearing holders 40 are connected to a chain wheel shaft in the shell, a shaft parallel to the hinge shaft is connected between second ends of the bearing holders 40, the gear pairs 39 cooperating with each other are mounted on the shaft and the hinge shaft, the second chain wheel 38 is mounted on the chain wheel shaft in the shell, the two sets of rollers 37 in the parallel rails 48 are connected to a roller shaft through the second chain wheel 38, the chain plate 98 cooperating with the second chain wheel 38 is mounted on the roller shaft, an end of the chain plate 98 is connected to a connection rod of the feeding rack, a spring plate 44 is connected to the bearing holder 40, an end of the spring plate 44 is connected to shells of the rooms, a force is loaded on the spring board 44 for tightly connecting the second chain wheel 38 to the chain plate 98.

Figure 6:
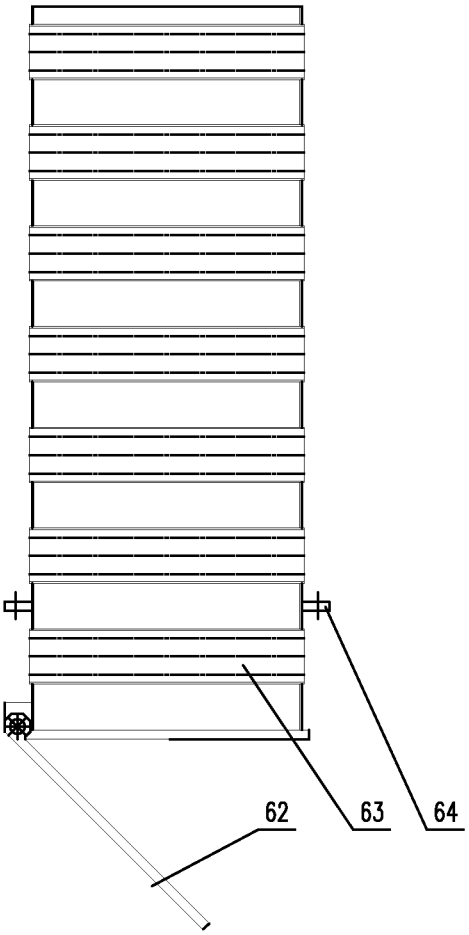
FIG. 6 is a sketch view of a feeding tank according to the FIG. 1 of the present invention.
Figure 7:
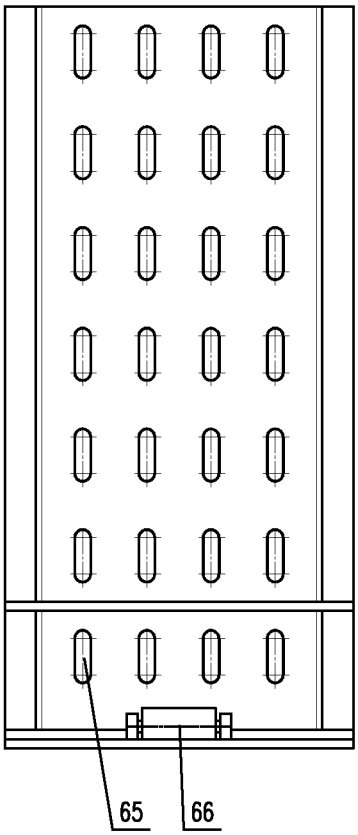
FIG. 7 is a left view according to the FIG. 6 of the present invention.

Referring to FIG. 6 and FIG. 7 of the drawings, in the feeding thank 2, a plurality of rows of oval shaped vent tubes 65 passing through the material container 63 are provided on opposite walls thereof. Holes through which the material container is communicated with are drilled on the vent tube 65. A bottom of the feeding tank 2 is a bottom rotary door 62 with the hinge 66 which rotates outwardly. A frame 64 is welded on the material container 63.

The vacuum pumps are Roots pumps 6 and rotary vane pumps 5. A main pump valve 11 tube and a by pass valve 13 tube are connected to the hydrogen adsorption room 14 and the heat dehydrogenation room 23. The main pump valve 11 tube and the by pass valve 13 tube are connected in parallel. Inert gas inlet tubes are provided on the rotary vane pump and a filter connection tube. When the vacuum pump is stopped, the inert gases are inflated (for breaking vacuum). Filters 12 are provided on the hydrogen adsorption room 14, heating dehydrogenation, a second vacuum pump 10, a third vacuum pump 14 and a fourth vacuum pump 26. A first valve 8, a second valve 22 and a third valve 25 utilize a first vacuum pump 4 through a flapper valve 7.

A usage method of the present invention is illustrated as below.

Referring to the FIG. 1 of the drawings, the usage method of the present invention is illustrated, comprising steps of: checking an electric power source, a gas power source, a circulating cooling water source and a medium gas source at first; ensuring that all the devices are in good conditions and are in working states; utilizing a decentralized operation mode; satisfying a working requirement which means vacuum and starting a system and setting the system to an interlocking state; opening an inert gas dilution valve and adjusting to a predetermined flow rate; closing the second valve 22 and the third valve 25; ensuring that the heater 58 in the heating dehydrogenation room 23 is in a good condition; setting a flow rate of the medium gas to a predetermined value; setting all the sensors such as the electric contact pressure gauge 18, the vacuum gauge 19, the pressure sensor 20, the first thermocouple 21 and the second thermocouple 58 to a stable working state;

opening the first valve 8 when the hydrogen adsorption room 14 and the first valve 8 is under 1 atm; starting the first motor 1 and the third motor 46 in such a manner that the feeding rack 47 waiting on the inlet transition frame 3 is moved into the hydrogen adsorption room 14 while carrying the feeding tank 2; closing the first valve 8.

The first vacuum pump 4 comprises:

a Roots pump 6;

a rotary vane pump 5;

a flapper valve 7;

a bellows tube;

tubes; and inert gas inlet tube;

wherein the first valve 8 is evacuated through the flapper valve 7; when a pressure the first valve 8 is less than 0.1 Pa, the inert gases are inflated through the inert gas inlet tube 9.

The second vacuum pump 10 comprises:

a Roots pump;

a rotary vane pump;

a rough valve;

a by pass valve 13;

a bellows tube;

tubes; and a filter 12;

wherein the hydrogen adsorption room 14 is evacuated through a vacuum pump tube flange 42, when a pressure is less than 0.1 Pa and no leak is detected by an automatic vacuum test, the hydrogen adsorption room 14 is washed by the inert gases before evacuating, the hydrogen is inflated to 0.096 MPa through the hydrogen inlet tube 15, the valve on the hydrogen inlet tube 15 is automatically closed. After the rare earth permanent magnetic alloys in the feeding tank 2 are hydrogen-pulverized into powder, evacuation is provided and the inert gases are inflated. Exhaust is released from a roof after being washed by the inert gases. A pressure control and a temperature control are provided by the electric contact pressure gauge 18, the vacuum gauge 19, the pressure sensor 20 and the first thermocouple 21. The active safety valve 17 and the passive safety valve 16 are provided on a safety valve tube. An external wall of the hydrogen adsorption room 14 is water-cooled and a cooling water nozzle 41 is provided thereon.

The chain wheel on the transmission device, which means on the third motor 46, drives the chain 45 in such a manner that the feeding tank 2 is transmitted. Power is transferred into a vacuumed box by a sealed transmission shaft. Torque is transferred to the second chain wheel 38 through the bearing holder 40 by the gear pair 39 where the force is loaded by the spring plate 44. The second chain wheel 38 shifts a feeding rack shifting shaft. The roller 37 on the feeding rack moves on the rail 48. The photoelectric switch 33 is a limit switch for adjusting the frequency.

The hydrogen adsorption room 14, the heating dehydrogenation room 23 and the second valve 22 are in the inert gases and are pressure-balanced. When the second valve 22 is opened, the feeding tank 2 is moved into the heating dehydrogenation room 23. Then the second valve 22 is closed.

The third vacuum pump 24 comprises:

a Roots pump;

a rotary vane pump;

a rough valve;

a by pass valve;

a bellows tube;

a filter; and tubes;

wherein the heating dehydrogenation room 23 is evacuated by the evacuation flange 52, when a pressure is less than 0.1 Pa and no leak is detected by the automatic vacuum test, the heating dehydrogenation room 23 is washed by the inert gases inflated through the air inflation flange 50. Then the heating dehydrogenation room 23 is evacuated again. When the pressure is less than 0.1 Pa, heating is started and a dehydrogenation temperature is 500~900° C. After the powder is dehydrogenated, the evacuation is provided and the inert gases are inflated. Exhaust is released from the roof after being washed by the inert gases. The pressure control and the temperature control are provided by the pressure gauge, the vacuum gauge, the pressure sensor and the thermocouple. The active safety valve 17 and the passive safety valve 16 are provided on the safety valve tube flange 49. The insulation board 51 which can be opened from left or right and passes through the first air cylinder 59 is provided on the top of the heating furnace in the heating dehydrogenation room 23, comprising: the upper insulation board 53, the side insulation board 57 and the lower insulation board 59. The heaters 58 are provided on an upper portion, a medium portion and a lower portion of the insulation board 51 and are connected to a power cabinet through the water cooled electrode 56. The second thermocouple 55 controls temperatures of different zones.

The heating dehydrogenation room 23, the cooling room 47 and the third valve 25 are in the inert gases or vacuum and are pressure-balanced. When the third valve 25 is opened, the feeding tank 2 is moved into the cooling room 27. Then the third valve 25 is closed.

After the cooling room 27 has been evacuated by the fourth vacuum pump 26, the inert gases are inflated to 0.19~0.29 MPa. Then the second motor 28 is started. The fan 29 cools the feeding tank 2 and the powder therein. The vent tubes 65 are provided in the feeding tank 2 in such a manner that the powder is cooled by a cooling gas through the vent tubes 65. A heated gas is driven to pass through a high-efficiency heat exchanger 30 by the fan 29 for being cooled. Then the gas is blown through the air deflector 61 to the feeding tank 2.

The oval shaped vent tubes 65 passing through the material container 63 in the feeding tank 2 are utilized for increasing a contact area of the powder. The holes through which a chamber is communicated with are drilled on the oval shaped vent tube 65 for increasing a hydrogen adsorption speed, a dehydrogenation speed, a cooling speed and hydrogen pulverization efficiency. The feeding tank 2 is hung on the transmission device.

When the pressure of the cooling room 27 is 1 atm, the fourth valve 31 is opened. Then the feeding tank 2 is moved to the outlet transition frame 32.

The feeding tank 2 is moved through the loop frame to the inlet transition frame 3 and is on standby.

The discharge room can also be utilized. The discharge room is evacuated by the fourth vacuum pump 26 and the inert gases are inflated. The cooling room 27, the discharge room 94 and the valve are under an inert gas atmosphere and are pressure-balanced. When the valve is opened, the feeding tank 2 is moved into the discharge room. Then the third valve 25 is closed. An unload mechanism is started under the inert gas atmosphere for collecting the powder in the feeding tank 2 by the valve tubes and storing the powder in the material storage.

During production, a control system continuously scans a state of the device and runs automatically according to a preset program. All operations can be controlled on a human-computer interface of a computer.

A screen of an electric control system can provide information as follows: hydrogen purity; working states of vacuum pumps, pump valves and vacuum pump tubes; vacuity, pressure and heating temperatures of the evacuated rooms and valves; states of the medium gas and safety valves; alerts of the cooling water, the power gas pressure and the medium gas; alert managements; all relative process parameters (predetermined values and real values); input parameters; history process parameters and information. All main parts of the device can be operated through the screen.

Comparison of performances of products produced by the method according to the present invention and the conventional method:

Comparison example: mixing materials with a ratio of 18% Nd, 8.5% Pr, 3% Dy, 1.02% B, 0.3% Al and Fe as the rest; producing an alloy slice with a thickness of 0.2~0.5 mm by a vacuum quenching device; coarsely pulverizing the slice by a rotary hydrogen pulverization furnace; wherein during a hydrogen adsorption procedure, a pressure of the hydrogen in a reactor is 0.06~0.15 MPa, a hydrogen adsorption time is 100 min; keeping a dehydrogenation temperature at 590±25° C. for 4 h; powdering the slice by a jet mill; producing a alloy base by a magnetic press machine and vacuum sintering at 1050° C.

A preferred embodiment 1 utilized the same ratio as in the comparison example. And a continuous hydrogen pulverization method is utilized. During the hydrogen adsorption procedure, a pressure of the hydrogen is 0.06~0.15 MPa, a hydrogen adsorption time is 80 min, and a dehydrogenation temperature is kept at 590±25° C. for 4 h.

A preferred embodiment 2 utilized the same ratio as in the comparison example. And the continuous hydrogen pulverization method is utilized. During the hydrogen adsorption procedure, the pressure of the hydrogen is 0.06~0.15 MPa, the hydrogen adsorption time is 80 min, and the dehydrogenation temperature is kept at 590±25° C. for 3.5 h.

A preferred embodiment 3 utilized the same ratio as in the comparison example. And the continuous hydrogen pulverization method is utilized. During the hydrogen adsorption procedure, the pressure of the hydrogen is 0.06~0.15 MPa, the hydrogen adsorption time is 80 min, and the dehydrogenation temperature is kept at 650±25° C. for 3.5 h.

A preferred embodiment 4 utilized the same ratio as in the comparison example. And the continuous hydrogen pulverization method is utilized. During the hydrogen adsorption procedure, the pressure of the hydrogen is 0.09~0.20 MPa, the hydrogen adsorption time is 70 min, and the dehydrogenation temperature is kept at 650±25° C. for 3.5 h.

A preferred embodiment 5 utilized the same ratio as in the comparison example. And the continuous hydrogen pulverization method is utilized. During the hydrogen adsorption procedure, the pressure of the hydrogen is 0.09~0.20 MPa, the hydrogen adsorption time is 70 min, and the dehydrogenation temperature is kept at 650±25° C. for 3 h.

| | Subject | | | | | | |
|---|---|---|---|---|---|---|---|
| | Hydrogen adsorption | | Dehydrogenation | | | | Magnetic energy |
| Group | Pressure (MPa) | Time (min) | Temperature (° C.) | Time (h) | Remanence Br (KGs) | Coercivity Hcj (KOe) | product (BH) max (MGOe) |
| Comparison example | 0.06-0.15 | 100 | 590 ± 25 | 4 | 13.1 | 24.5 | 43.5 |
| Preferred embodiment 1 | 0.06-0.15 | 80 | 590 ± 25 | 4 | 13.3 | 25.5 | 44.2 |
| Preferred embodiment 2 | 0.06-0.15 | 80 | 590 ± 25 | 3.5 | 13.3 | 25.4 | 44.2 |
| Preferred embodiment 3 | 0.06-0.15 | 80 | 650 ± 25 | 3.5 | 13.4 | 25.8 | 45.5 |
| Preferred embodiment 4 | 0.09-0.20 | 70 | 650 ± 25 | 3.5 | 13.5 | 26.5 | 45.7 |
| Preferred embodiment 5 | 0.09-0.20 | 70 | 650 ± 25 | 3 | 13.5 | 26.5 | 45.7 |

According to the above examples, it can be seen that after hydrogen pulverization, heating dehydrogenation and cooling, size distribution and grain sharp of the rare earth powder are improved, which has a significant improvement effect on magnetic performance. At the same time, an automatic level of production is also greatly improved.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A continuous hydrogen pulverization method of a rare earth permanent magnetic alloy, comprising steps of:

A) displacing a feeding tank containing rare earth permanent magnetic alloy slices on a feeding rack, hanging the feeding rack on a transmission device, displacing the feeding tank into a hydrogen adsorption room, evacuating the hydrogen adsorption room after closing a valve, filling with hydrogen to 0.05-0.15 MPa after a vacuum pressure is lower than 50 Pa or a volume content of oxygen is less than or equal to 0.1%, keeping for 10~120 min, releasing the hydrogen, opening a first isolation valve between the hydrogen adsorption room and a heating dehydrogenation room when pressure in the hydrogen adsorption room equals to pressure in the heating dehydrogenation room, then displacing the feeding tank into the heating dehydrogenation room and closing the first isolation valve;

B) heating when the pressure in the heating dehydrogenation room is less than 0.1 Pa, wherein a highest heating temperature during heating is 500~900° C. with a heating time of 4~20 h, opening an second isolation valve between the heating dehydrogenation room and a cooling room when pressure in the heating dehydrogenation room equals to pressure in the cooling room, then displacing the feeding tank into the cooling room and closing the second isolation valve; and C) filling the cooling room with inert gases until gas pressure is 0.05-0.6 Mpa, then starting a fan for driving the inert gases into a vent tube of the feeding tank through a cambered deflector on an internal wall of the cooling room; after the inert gases enters the vent tube, cooling the feeding tank and the alloy slices in the cooling room with the inert gases, then cooling the heated inert gases by a heat exchanger before being blown to the cambered deflector for providing inert gas circulating cooling, adjusting the pressure to 1 atm when a temperature is lower than or equal to 120° C. due to the inert gas circulating cooling, opening an material outlet for taking the feeding tank out.

2. The continuous hydrogen pulverization method, as recited in claim 1, wherein two or more heating dehydrogenation rooms are provided, the heating time in the step B) is equally allocated to each the heating dehydrogenation room.

3. The continuous hydrogen pulverization method, as recited in claim 1, wherein two or more cooling rooms are provided, a cooling time in the step C) is equally allocated to each the cooling room.

* * * * *